US008042800B2

(12) United States Patent
Hsu

(10) Patent No.: US 8,042,800 B2
(45) Date of Patent: Oct. 25, 2011

(54) SHEET PICK-UP DEVICE OF AUTOMATIC DOCUMENT FEEDER

(75) Inventor: Wei-Hsun Hsu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/685,304

(22) Filed: Jan. 11, 2010

(65) Prior Publication Data

US 2011/0115147 A1 May 19, 2011

(30) Foreign Application Priority Data

Nov. 13, 2009 (TW) ..... 98138657 A

(51) Int. Cl.
*B65H 3/52* (2006.01)

(52) U.S. Cl. ..... 271/121

(58) Field of Classification Search ..... 271/121
See application file for complete search history.

(56) References Cited

U.S. PATENT DOCUMENTS 6,598,873 B2 * 7/2003 Takisawa et al. ..... 271/246
7,255,339 B2 * 8/2007 Hung et al. ..... 271/122
7,571,905 B2 * 8/2009 Kim ..... 271/117
7,717,415 B2 * 5/2010 Kim et al. ..... 271/110
7,753,363 B2 * 7/2010 Liu et al. ..... 271/121
2002/0096819 A1 * 7/2002 Fukasawa et al. ..... 271/121
2005/0035534 A1 * 2/2005 Kim et al. ..... 271/152
2005/0184449 A1 * 8/2005 Morimoto et al. ..... 271/118
2005/0263955 A1 * 12/2005 Kim ..... 271/121
2006/0049572 A1 * 3/2006 Miyazawa ..... 271/121
2007/0158898 A1 * 7/2007 Hung et al. ..... 271/109
2008/0197560 A1 * 8/2008 Lee et al. ..... 271/121

* cited by examiner

*Primary Examiner* — Kaitlin Joerger
*Assistant Examiner* — Patrick Cicchino
(74) *Attorney, Agent, or Firm* — Kirton & McConkie; Evan R. Witt

(57) ABSTRACT

A sheet pick-up device of an automatic document feeder is used for feeding a sheet into a sheet feeding path. The sheet pick-up device includes a sheet pick-up module and a sustaining element. The sheet pick-up module includes a driving shaft and a sheet pick-up arm coupled to the driving shaft. The sheet pick-up arm is driven by the driving shaft to be rotated to either a standby position or a sheet feeding position. The sustaining element is pivotally coupled to the sheet pick-up arm. When a distal end of the sustaining element is rotated to be in contact with the sheet feeding path, the sheet pick-up arm stays in the standby position.

4 Claims, 8 Drawing Sheets

SHEET PICK-UP DEVICE OF AUTOMATIC DOCUMENT FEEDER

FIELD OF THE INVENTION

The present invention relates to a sheet pick-up device of an automatic document feeder, and more particularly to a sheet pick-up device capable of staying in a standby position in case of electricity interruption.

BACKGROUND OF THE INVENTION

With rapid development of electronic and information industries, a diversity of office machines such as printers, faxing machines or scanners become essential electronic devices in the offices.

Among these office machines, image scanning apparatuses with scanning functions or multifunction peripherals are more popular become they are indispensable to office automation. As known, an image scanning apparatus usually has an automatic document feeder for successively and continuously feeding a stack of paper sheets into the inner portion of the image scanning apparatus. For example, a conventional automatic document feeder has been disclosed in U.S. Pat. No. 6,792,241, which is entitled "Sheet feeding apparatus, image scanning apparatus and image forming apparatus provided with the image reading apparatus". FIGS. 1A and 1B are schematic views illustrating an automatic document feeder disclosed in U.S. Pat. No. 6,792,241. As shown in FIG. 1A, the automatic document feeder 1 comprises a sheet pick-up arm 10, a stopper 20 and a sheet feeding path C. With the cooperation of the sheet pick-up arm 10 and the stopper 20, the automatic document feeder 1 may pick up an uppermost sheet from a stack of sheets and feed the uppermost sheet into the sheet feeding path C. In addition, the sheet pick-up arm 10 comprises a pressing piece 10*a* and a sheet pick-up roller 3. The stopper 20 comprises a pressing portion 20*a* and a stopping surface 20*b*.

The sheet pick-up arm 10 is used for feeding the sheets S into the sheet feeding path C of the automatic document feeder 1. In a case that no sheet-feeding operation is done, the sheet pick-up arm 10 is distant from the sheet feeding path C and thus the sheet pick-up arm 10 is in a standby position (see FIG. 1A). For a purpose of feeding the sheets S, the sheet pick-up arm 10 is lowered to a sheet feeding position (see FIG. 1B).

Please refer to FIG. 1A again. When the sheet pick-up arm 10 is lifted to the standby position, the stopper 20 that is arranged in the sheet feeding path C is rotated to be upright according to the gravity of the sheet pick-up arm 10. As such, the stopping surface 20*b* is vertical to sheet feeding path C to stop the sheets S from entering the sheet feeding path C.

Please refer to FIG. 1B again. When the sheet pick-up arm 10 is lowered to the sheet feeding position, the sheet pick-up roller 3 that is arranged at the front end of the sheet pick-up arm 10 is in contact with the sheets S. Meanwhile, the pressing portion 20*a* of the stopper 20 is pressed by the pressing piece 10*a* of the sheet pick-up arm 10, and thus the stopping surface 20*b* is lowered to the position under the sheet feeding path C. Under this circumstance, the sheets S may be fed into the sheet feeding path C without being stopped by the stopper 20. In other words, the uppermost sheet is allowed to be fed into the inner portion of the automatic document feeder 1.

Nowadays, with increasing awareness of environmental protection, more and more electrical apparatuses are designed in views of power-saving concepts. For achieving a power-saving purpose, an electrical apparatus is operated in a sleeping mode if the electrical apparatus is not used. The office machine with an automatic document feeder has the similar power-saving functions. In a case that the automatic document feeder is in a sleeping mode, no electricity is supplied to the sheet pick-up module. Due to interruption of electricity, the sheet pick-up arm 10 fails to continuously stay in the standby position. In other words, the sheet pick-up arm 10 will be lowered to the sheet feeding position in the sleeping mode. Under this circumstance, the sheet stopping function of the stopper 20 is disabled. If the user forgets that the automatic document feeder is in the sleeping mode but forces a stack of sheets to be introduced into the automatic document feeder, many sheets may be erroneously inserted into the sheet feeding path C. After the automatic document feeder is powered on and the automatic document feeder is in a working mode, the sheet pick-up roller 3 that is arranged at the front end of the sheet pick-up arm 10 will be in contact with the too many sheets. Since too many sheets are simultaneously fed into the internal portion of the sheet feeding path C, a so-called double feeding problem occurs. Meanwhile, since too many sheets are jammed in the sheet feeding path C, the automatic document feeder fails to be normally operated.

SUMMARY OF THE INVENTION

It is an object of the present invention to provide a sheet pick-up device of an automatic document feeder. The sheet pick-up device stays in a standby position when the automatic document feeder is in a sleeping mode or a power-saving mode, thereby overcoming the double feeding problem.

In accordance with an aspect of the present invention, there is provided a sheet pick-up device of an automatic document feeder. The sheet pick-up device is used feeding a sheet into a sheet feeding path of the automatic document feeder. The sheet pick-up device includes a sheet pick-up module and a sustaining element. The sheet pick-up module includes a driving shaft and a sheet pick-up arm pivotally coupled to the driving shaft. The sheet pick-up arm is driven by the driving shaft to be rotated to either a standby position or a sheet feeding position. The sheet is fed into the sheet feeding path by the sheet pick-up module when the sheet pick-up arm is rotated to the sheet feeding position. The sustaining element is pivotally coupled to the sheet pick-up arm. The sheet pick-up arm stays in the standby position when a distal end of the sustaining element is rotated to be in contact with the sheet feeding path.

In an embodiment, the sheet pick-up arm further includes a pivotal hole and a concave structure with an inclined surface. The sustaining element further includes a rotating shaft and a swing arm. The rotating shaft is penetrated through the pivotal hole, so that the swing arm is rotatable with respect to the sheet pick-up arm.

In an embodiment, the sheet pick-up device further includes a sheet stopping mechanism, which is disposed in the sheet feeding path.

In an embodiment, an indentation is formed in a surface of the sheet feeding path. A protrusion is formed at the distal end of the sustaining element and corresponding to the indentation. The protrusion is engaged with the indentation when the sustaining element is in contact with the sheet feeding path.

In an embodiment, an anti-slip element is disposed on the distal end of the sustaining element to be in contact with the sheet feeding path.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a sheet pick-up device of an automatic document feeder. In accordance with a key feature of the present invention, a sustaining element is disposed on a sheet pick-up arm in order to obviate the drawbacks encountered in the prior art.

Figure 1A:
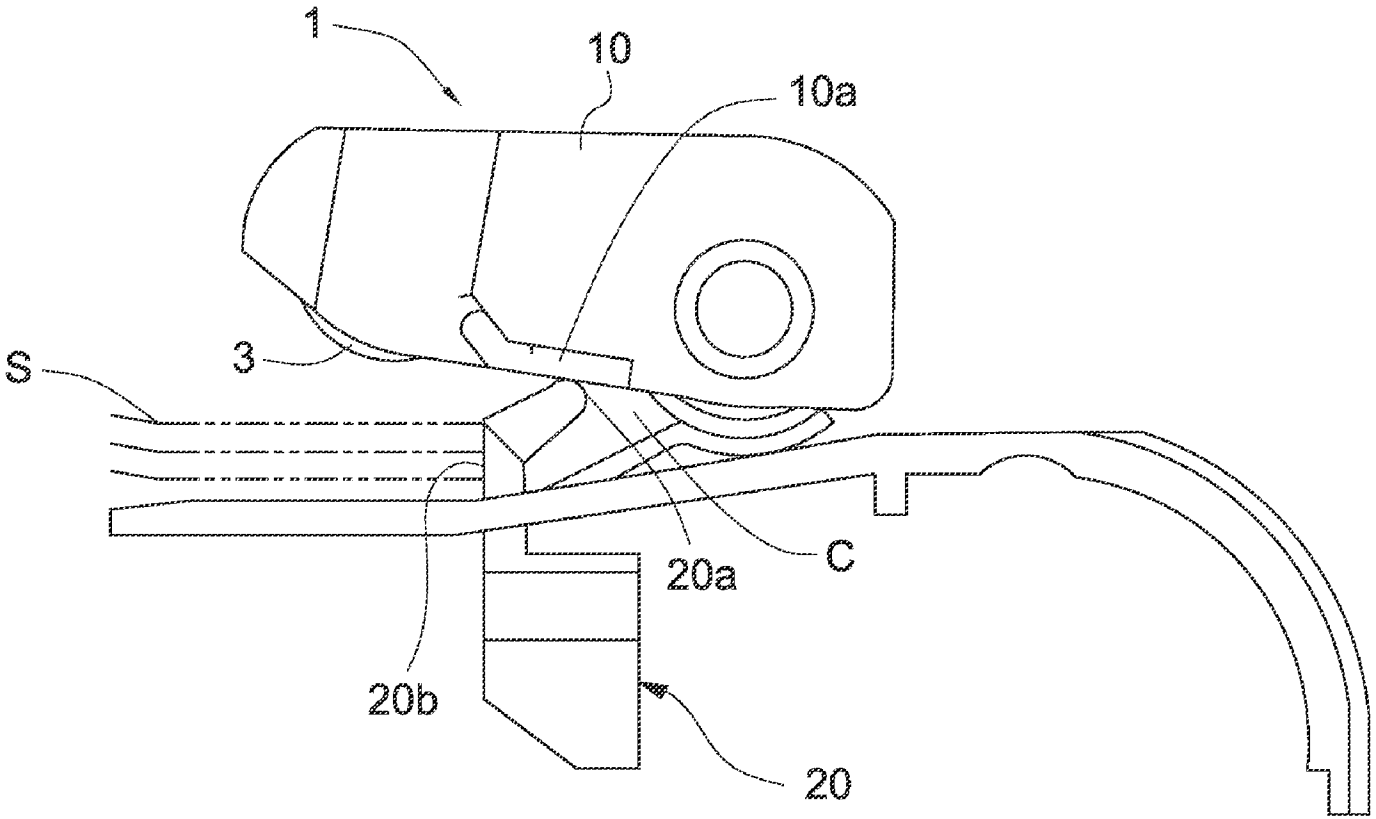
FIG. 1A(PRIOR ART)
FIGS. 1A and 1B are schematic views illustrating a conventional automatic document feeder.
Figure 1B:
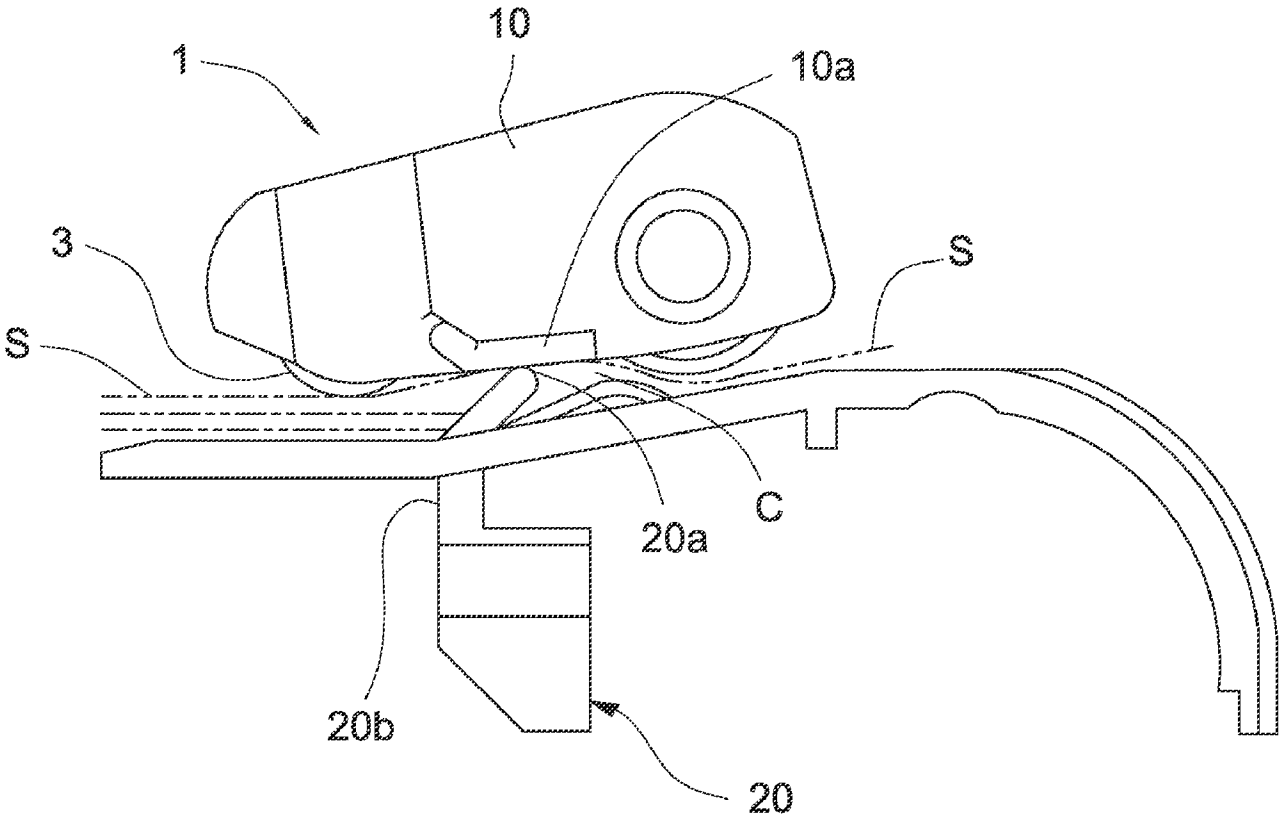
FIG. 1B(PRIOR ART)
Figure 2:
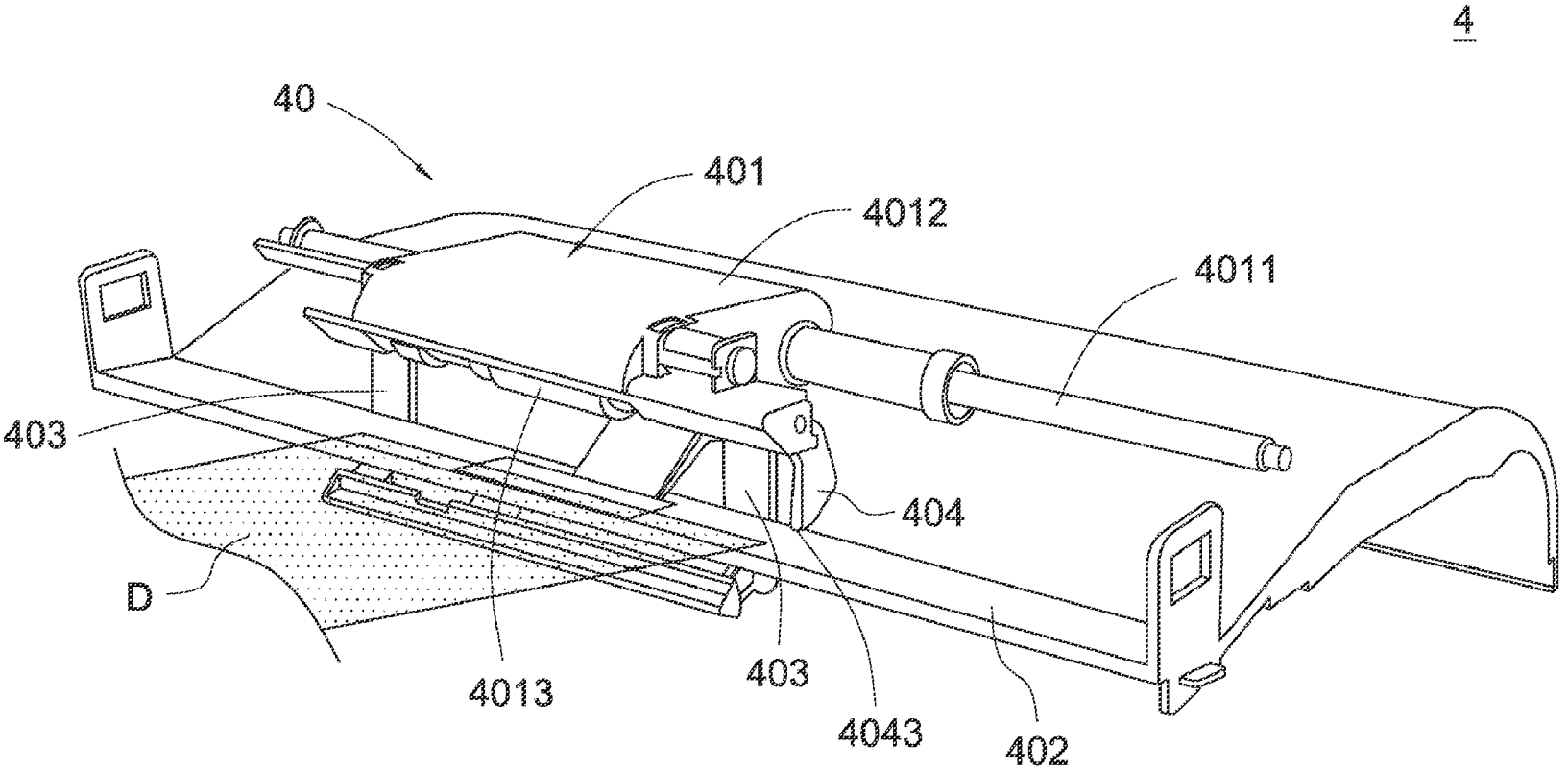
FIG. 2 is a schematic perspective view illustrating an automatic document feeder according to an embodiment of the present invention.

FIG. 2 is a schematic perspective view illustrating a sheet pick-up device of an automatic document feeder according to an embodiment of the present invention. As shown in FIG. 2, the sheet pick-up device 40 of the automatic document feeder 4 comprises a sheet pick-up module 401, a sheet feeding path 402, a sheet stopping mechanism 403 and a sustaining element 404. The sheet pick-up module 401 comprises a driving shaft 4011, a sheet pick-up arm 4012 and a sheet pick-up roller 4013. The sustaining element 404 is pivotally coupled to a sidewall of the sheet pick-up arm 4012. When the sheet pick-up module 401 stays in the standby position, a distal end 4043 of the sustaining element 404 is in contact with the sheet feeding path 402.

Figure 3A:
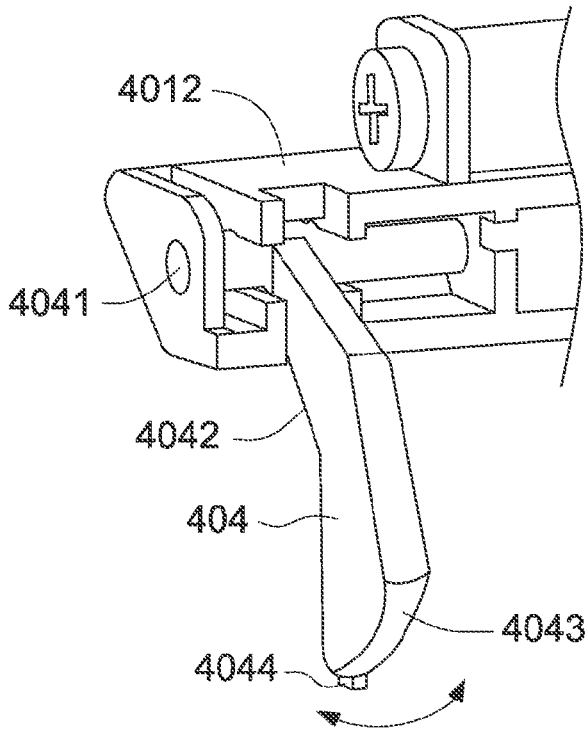
FIG. 3A is a schematic perspective view illustrating the connection between the sustaining element and the sheet pick-up arm of the sheet pick-up device as shown in FIG. 2.
Figure 3B:
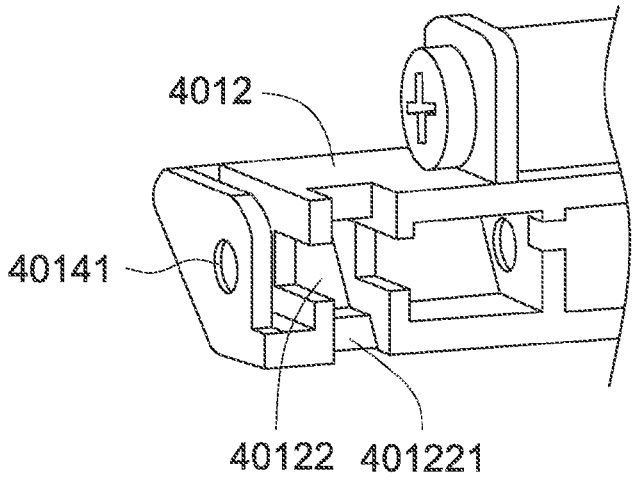
FIG. 3B is a schematic perspective view illustrating the connecting region between the sustaining element and the sheet pick-up arm.

FIG. 3A is a schematic perspective view illustrating the connection between the sustaining element and the sheet pick-up arm of the sheet pick-up device as shown in FIG. 2. As shown in FIG. 3A, the sustaining element 404 comprises a rotating shaft 4041 and a swing arm 4042. FIG. 3B is a schematic perspective view illustrating the connecting region between the sustaining element and the sheet pick-up arm. As shown in FIG. 3B, the sheet pick-up arm 4012 further comprises a pivotal hole 40141 and a concave structure 40122. The concave structure 40122 has an inclined surface 401221. The rotating shaft 4041 of the sustaining element 404 is penetrated through the pivotal hole 40141 of the sheet pick-up arm 4012, so that the swing arm 4042 of the sustaining element 404 is rotatable with respect to the sheet pick-up arm 4012.

FIGS. 4A~4D are schematic views illustrating operations of the sheet pick-up device as shown in FIG. 2.

Figure 4A:
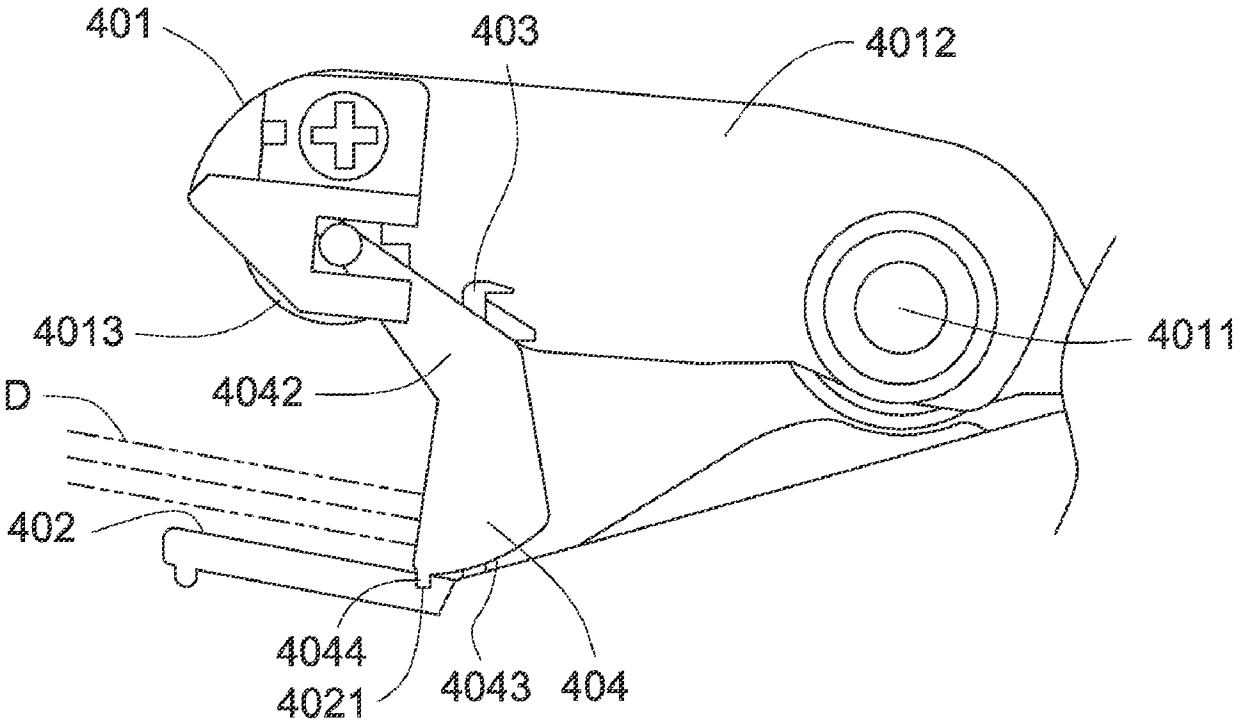
FIGS. 4A~4D are schematic views illustrating operations of the sheet pick-up device as shown in FIG. 2.

As shown in FIG. 4A, the automatic document feeder 4 is in a sleeping mode and no electricity is supplied to the automatic document feeder 4. Due to the gravity of the sheet pick-up arm 4012 of the sheet pick-up module 401, the distal end 4043 of the swing arm 4042 of the sustaining element 404 which is coupled to the sheet pick-up arm 4012 will be in contact with the surface of the sheet feeding path 402. As such, the sheet pick-up arm 4012 stays in the standby position. Furthermore, an indentation 4021 is formed in the surface of the sheet feeding path 402. Corresponding to the indentation 4021, a protrusion 4044 is formed at the distal end 4043 of the swing arm 4042 of the sustaining element 404. When the distal end 4043 of the swing arm 4042 of the sustaining element 404 is in contact with the surface of the sheet feeding path 402, the protrusion 4044 is engaged with the indentation 4021 in the surface of the sheet feeding path 402. As a consequence, the sustaining element 404 could be steadily contacted with the surface of the sheet feeding path 402. Under this circumstance, even if the angle of the sustaining element 404 with respect to the surface of the sheet feeding path 402 is improper or a tiny force is external on the sustaining element 404, the sustaining element 404 could be still fixed in the indentation 4021 while keeping the sustaining function.

Moreover, for facilitating steady contact between the sustaining element 404 and the surface of the sheet feeding path 402 to keep the sustaining function of the sustaining element 404 (even if the angle of the sustaining element 404 with respect to the surface of the sheet feeding path 402 is improper or a tiny force is external on the sustaining element 404), the distal end 4043 of the sustaining element 404 is sheathed by an anti-slip element. Alternatively, the anti-slip element is integrated into the distal end 4043 of the sustaining element 404. The use of the anti-slip element may increase the friction between the distal end 4043 of the sustaining element 404 and the surface of the sheet feeding path 402. In an embodiment, the anti-slip element is made of natural rubber (NR), polyurethane (PU) rubber, styrene-butadiene rubber (SBR), or the like.

Figure 4B:
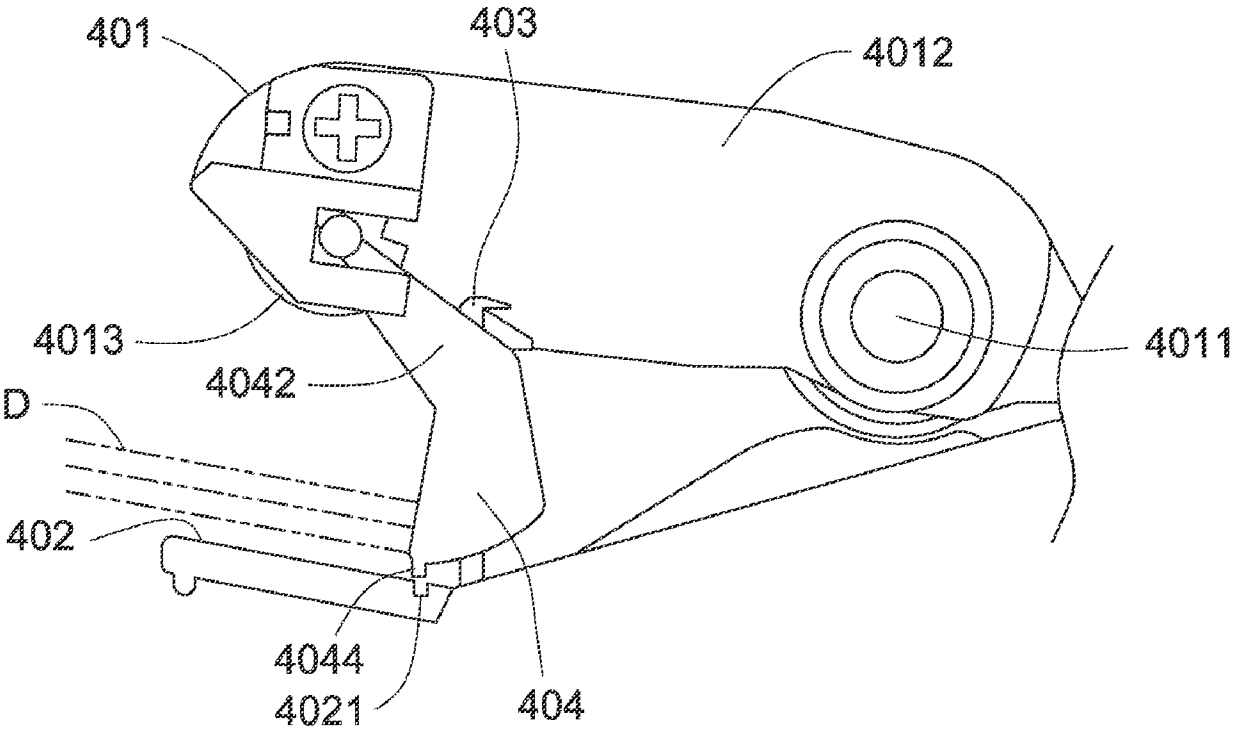

When the automatic document feeder 4 is switched from the sleeping mode to the working mode, electricity is normally supplied to the automatic document feeder 4 (see FIG. 4B). Meanwhile, the driving shaft 4011 of the sheet pick-up module 401 is rotated to drive rotation of the sheet pick-up arm 4012. Upon rotation of the sheet pick-up arm 4012, the sheet pick-up arm 4012 is uplifted to a position higher than the standby position such that the sustaining element 404 is no longer in contact with the sheet feeding path 402 and may be freely swung. At the same time, the sheet stopping mechanism 403 is maintained upright to stop the sheets from entering the sheet feeding path 402.

Figure 4C:
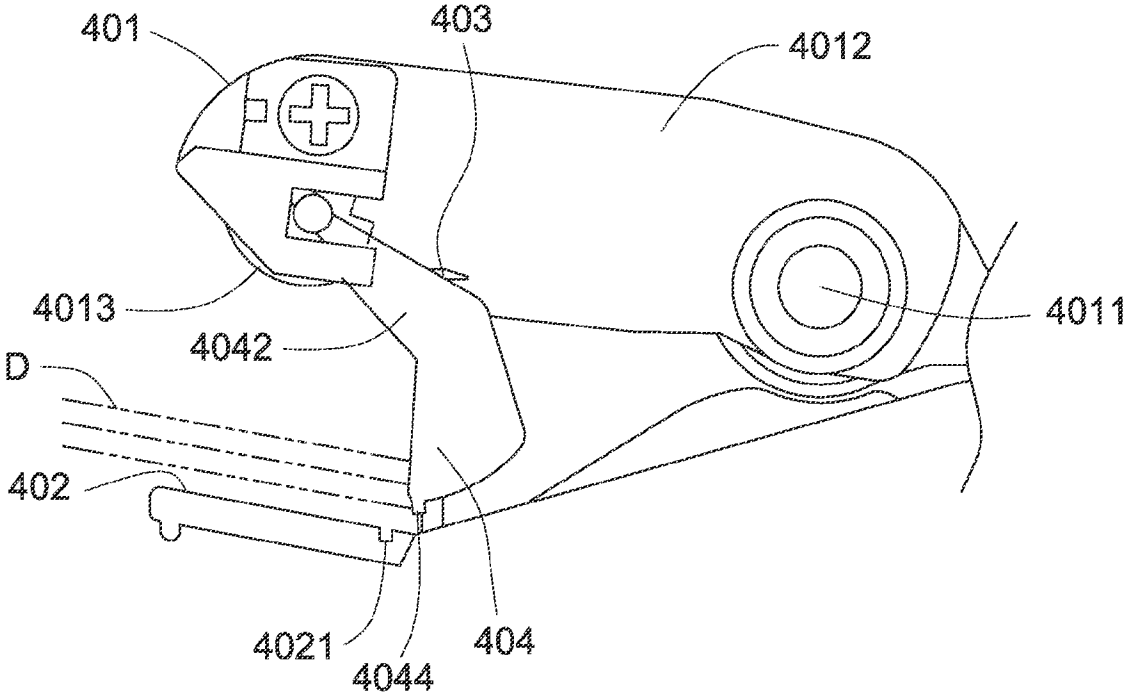
Figure 4D:
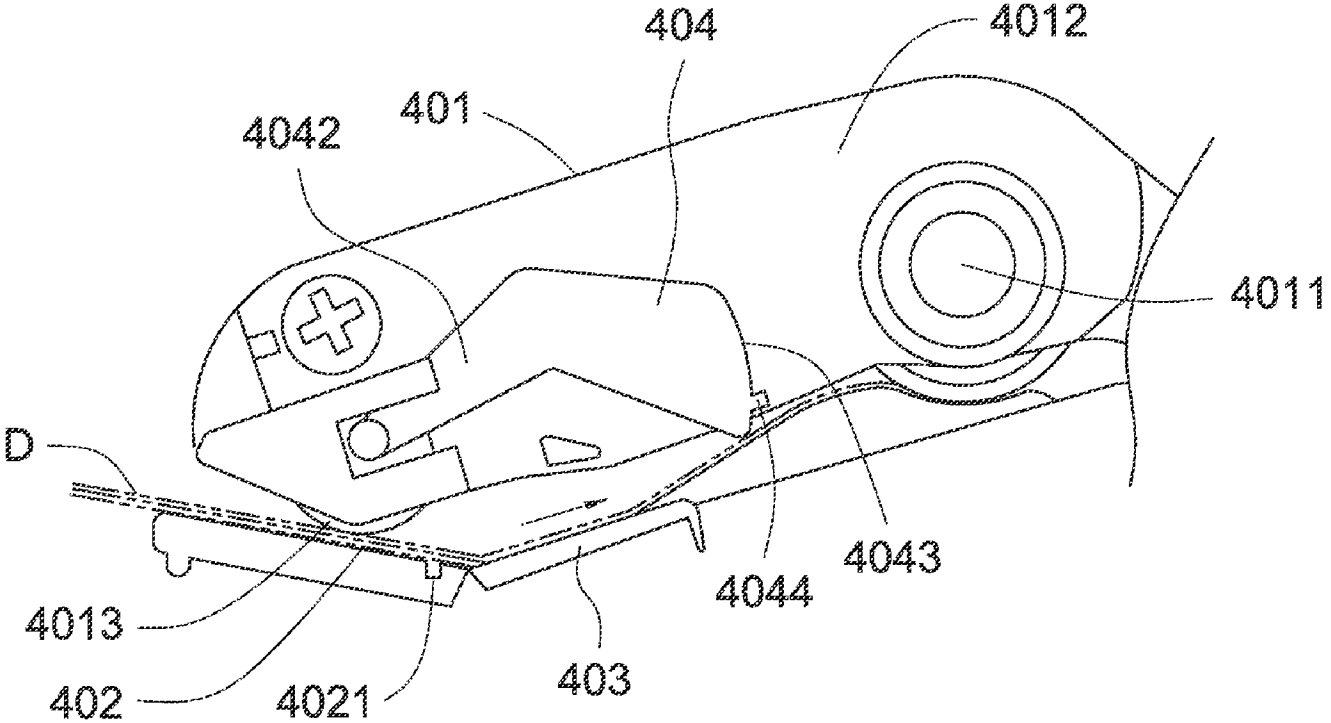

Next, as shown in FIG. 4C, the sustaining element 404 will be pushed forward by the sheets D that is placed in the sheet feeding path 402 of the automatic document feeder 4. As such, the sustaining element 404 is rotated and the distal end 4043 of the sustaining element 404 is distant from the sheet feeding path 402.

For performing the sheet feeding operation, as shown in FIG. 4 D, the driving shaft 4011 of the sheet pick-up module 401 is rotated drive rotation of the sheet pick-up arm 4012. Upon rotation of the sheet pick-up arm 4012, the sheet pick-up arm 4012 is lowered to the sheet feeding position. During the sheet pick-up arm 4012 is lowered, the sheet stopping mechanism 403 is rotated to be distant from the sheet feeding path 402. Meanwhile, the sheets D is no longer stopped by the sheet stopping mechanism 403, so that the sheets D could be successively fed into the sheet feeding path 402 by the sheet pick-up roller 4013. After the sheet D is fed into the inner portion of the automatic document feeder 4, the sustaining element 404 is freely swung. In other words, the sheet D could be transported forwardly without being hindered by the sustaining element 404.

From the above description, the sheet pick-up device for use in the automatic document feeder of the present invention still stays in a standby position in case of electricity interruption. When the automatic document feeder is in a sleeping mode, the sustaining element is in contact with the surface of the sheet feeding path and support the gravity of the sheet pick-up arm. As such, even if the user forgets that the automatic document feeder is in the sleeping mode but forces a stack of sheets to be introduced into the automatic document feeder, the sheet pick-up arm still stays in the standby position and thus the problem of erroneously inserting many sheets into the sheet feeding path is eliminated. After the automatic document feeder is powered on and the automatic document feeder is in a working mode, the sheet pick-up roller is not in contact with the sheets because the sheet pick-up arm still stays in the standby position. Since too many sheets are no longer simultaneously fed into the internal portion of the sheet feeding path, the double feeding problem will be overcome. In other words, the possibility of getting jam of the sheet feeding path is minimized and thus the automatic document feeder could be normally operated.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet pick-up device of an automatic document feeder for feeding a sheet into a sheet feeding path of said automatic document feeder, said sheet pick-up device comprising:

a sheet pick-up module comprising a driving shaft and a sheet pick-up arm pivotally coupled to said driving shaft, wherein said sheet pick-up arm is driven by said driving shaft to be rotated to either a standby position or a sheet feeding position, and said sheet is fed into said sheet feeding path by said sheet pick-up module when said sheet pick-up arm is rotated to said sheet feeding position; and a sustaining element pivotally coupled to said sheet pick-up arm, wherein when said sheet pick-up arm stays in said standby position, when a distal end of said sustaining element is rotated to be in contact with the surface of said sheet feeding path, wherein an anti-slip element is disposed on said distal end of said sustaining element to be in contact with said sheet feeding path.

2. The sheet pick-up device of an automatic document feeder according to claim 1 wherein said sheet pick-up arm further includes a pivotal hole and a concave structure with an inclined surface, said sustaining element further includes a rotating shaft and a swing arm, and said rotating shaft is penetrated through said pivotal hole, so that said swing arm is rotatable with respect to said sheet pick-up arm.

3. The sheet pick-up device of an automatic document feeder according to claim 1 further comprising a sheet stopping mechanism, which is disposed in said sheet feeding path.

4. The sheet pick-up device of an automatic document feeder according to claim 1 wherein an indentation is formed in a surface of said sheet feeding path, and a protrusion is formed at said distal end of said sustaining element and corresponding to said indentation, wherein said protrusion is engaged with said indentation when said sustaining element is in contact with said sheet feeding path.

* * * * *